United States Patent [19]

Hirakis

[11] 4,152,181

[45] May 1, 1979

[54] COBALT ALLOY HEAT TREATMENT

[75] Inventor: Emanuel C. Hirakis, Mansfield, Conn.

[73] Assignee: United Technologies Corporation, Hartford, Conn.

[21] Appl. No.: 864,963

[22] Filed: Dec. 27, 1977

[51] Int. Cl.[2] ..... C22C 19/07

[52] U.S. Cl. ..... 148/158; 75/171; 148/32.5

[58] Field of Search ..... 148/32, 32.5, 158; 15/170, 171

[56] References Cited

U.S. PATENT DOCUMENTS

| | | | |
|---|---|---|---|
| 3,366,478 | 1/1968 | Wheaton | 75/171 |
| 3,432,294 | 3/1969 | Wheaton | 75/171 |
| 3,615,375 | 10/1971 | Beltran et al. | 75/171 |
| 3,718,461 | 2/1973 | Dewey | 75/171 |
| 4,078,922 | 3/1978 | Magyar et al. | 148/32 |

*Primary Examiner*—R. Dean
*Assistant Examiner*—Peter K. Skiff
*Attorney, Agent, or Firm*—Charles E. Sohl

[57] ABSTRACT

A stabilization heat treatment for a class of wrought cobalt alloys is described. The heat treatment produces a useful combination of initial ductility, so as to permit fabrication of intricate parts, and adequate ductility even after long term exposure at elevated temperatures as, for example, that exposure encountered in gas turbine service. The heat treatment consists of a solution treatment performed at elevated temperatures followed by two aging steps at lower temperatures. The nominal alloy composition is 22.5% chromium, 4.25% aluminum, 15% (nickel+iron), 3% (tantalum+columbium), 10% (tungsten+molybdenum), 1.25% hafnium, 0.05% yttrium, 0.35% carbon, balance essentially cobalt.

3 Claims, No Drawings

COBALT ALLOY HEAT TREATMENT

CROSS REFERENCE TO RELATED APPLICATION

This application is closely related to application U.S. Ser. No. 638,882, now U.S. Pat. No. 4,078,922 on which a Notice Of Allowance was mailed on Oct. 5, 1977.

BACKGROUND OF THE INVENTION

1. Field of the Invention

This invention relates to the heat treatment of cobalt base alloys for use at elevated temperatures.

2. Description of the Prior Art

This invention relates to a heat treatment for a specific cobalt base alloy. This cobalt alloy is disclosed in U.S. Pat. application U.S. Ser. No. 638,882 now U.S. Pat. No. 4,078,922 on which a Notice Of Allowance was mailed on Oct. 5, 1977. The subject matter of this allowed United States patent application is expressly incorporated herein by reference. This allowed United States patent application contains claims directed at the alloy in two forms, compositions suitable for the production of cast parts and compositions suitable for the production of wrought parts. The present invention relates to a heat treatment which is useful in the connection for the production of wrought parts. The alloy composition range suitable for the production of wrought parts is presented in Table I which shows broad and preferred ranges from allowed application Ser. No. 638,882, now U.S. Pat. No. 4,078,922 and a preferred composition for use in conjunction with the heat treatment of the invention. This alloy is unique since the protective film which forms in service and prevents further surface attack is based on alumina rather than chromia film which is found in virtually all other cobalt superalloys. The composition of this alloy differs from the composition of other known alloys and consequently its heat treatment would not be expected to be similar to heat treatments employed with prior art alloys.

TABLE I

| | Broad | Preferred | Most Preferred |
|---|---|---|---|
| Cr | 18–27 | 18–25 | 18–23 |
| Ni+Fe | 10–20 | 13–17 | 13–17 (1) |
| W+Mo | 8–12 | 8–10 | 8–10 (2) |
| Ta+Cb | 2–14 | 2–4 | 2–4 (3) |
| C | .25–.45 | .25–.45 | .25–.45 |
| Al | 3.5–5.0 | 3.7–4.6 | 4.2–4.6 |
| Hf | .5–2.0 | .5–2.0 | .5–2.0 |
| Ti | 0–.5 | 0–.5 | 0–.5 |
| Y | .02–.07 | .02–.07 | .02–.07 |
| B | 0–.5 | 0–.5 | 0–.5 |
| Co | Bal | Bal | Bal |

(1) Ni only
(2) W only
(3) Ta only

The monograph entitled "Cobalt Base Superalloys 1970," published by the Cobalt Information Center in 1970, contains a brief summary of the heat treatment supplied to cobalt base superalloys. Briefly, these conventional heat treatments usually involve a solution heat treatment at a temperature in excess of 2000° F. followed by an optional aging treatment at a lower temperature to produce precipitation of a desired phase. The aging treatments employed range from about 1200° to about 1500° F.

SUMMARY OF THE INVENTION

The invention relates to a three-step heat treatment for use with a particular class of cobalt superalloys whose composition is shown in Table I. The heat treatment of the invention includes an initial solution treatment step at a temperature of from about 2250° F. to about 2350° F. for a period of time of about twenty minutes. This solution treatment step is followed by an aging treatment at a temperature of from about 2100° F. to about 2200° F. for a period of time from about one-half to about two hours followed by another treatment at a temperature of from about 1800° F. to about 2050° F. for a period of time from about one hour to about four hours. The heat treatment is applied to wrought articles and provides a useful combination of ductility in the heat treated condition, which permits the article to be formed and cold worked, and also provides a useful amount of ductility even after prolonged exposures at elevated temperatures. This latter ductility aids the alloy in resisting thermal fatigue.

DESCRIPTION OF THE PREFERRED EMBODIMENTS

This invention relates to heat treatment for cobalt alloy whose composition has been listed previously in Table I. This alloy has particular utility for use in burners in gas turbine engines. Such burners are formed from wrought sheet and must have adequate ductility to permit forming. Gas turbine burners are exposed to extreme temperatures. The flame temperature within the burner may exceed 3000° F. The outer surface of the burner is air cooled with air whose temperature may be less than 100° F., thus, the burner is subjected to a great degree of thermal stress. This thermal stress fluctuates during engine operation as both the temperature within the burner and the temperature of the cooling air may vary significantly. Thus, it is important that the burner can be resistant to thermal fatigue. It was initially thought that the cobalt base alloy, described in application U.S. Ser. No. 638,882, now U.S. Pat. No. 4,078,922 would provide adequate service if it were employed in the solution treated condition. Typically, a solution treatment involves a short term exposure at a temperature of about 2300° F. followed by rapid cooling. Such a solution treatment provided material having exceptional ductility, material which was easily formed into intricate shapes. However, engine tests of burners formed from solution treated alloys showed thermal fatigue failures after extended service at elevated temperatures. Average in service metal temperatures range from about 1400° F. to about 1800° F. Laboratory tests revealed that when the subject alloy was solution treated and quenched, it had a Rockwell C hardness of about 25. After a 100 hour exposure at 1400° F., the hardness had increased to about 50. After a 100 hour exposure at 1800° F. the hardness had increased to about 32. This test indicated that significant aging by precipitation of phases was occurring under in-service conditions. Along with the increase in hardness, there was a significant decrease in ductility, that is to say, the material became brittle and failed without much elongation at elevated temperature. This decrease in ductility was believed largely responsible for the thermal fatigue failures which had been observed.

To alleviate this embrittlement phenomena caused by aging under in-service conditions, the 2300° F. solution treatment was augmented by a lower temperature aging step, at about 2150° F. for one hour. This proved to be partially successful in alleviating the ductility reduction. A temperature of 1400° F. was selected as a typical in-service metal temperature for the burner can application for which the alloy was used. A time of 1,000 hours was selected as being typical of the time which a burner can would spend at elevated temperatures in commercial gas turbine service. The heat treatments were evaluated in terms of ductility immediately after the heat treatment and after 1,000 hour exposure at 1400° F. The ductility immediately after heat treatment is important since the heat treatment is performed during the burner manufacturing operation and since subsequent cold working operation will be performed to produce the final burner configuration. After a solution treatment of 2300° F. for 20 minutes the material had a room temperature ductility to failure of about 50%, a ductility which is greatly in excess of that required for the fabrication operation. However, after 1,000 hours at 1400° F., this solution treated material had a room temperature ductility to failure of only 5%. A theoretical analysis of the stresses encountered during burner operation combined with actual test results indicated that a room temperature ductility of about 12% was the minimum which would insure thermal fatigue free burner operation over long time periods. A solution treatment at 2300° F. followed by a one hour aging treatment at 2150° F. showed a room temperature ductility as treated of about 30%, again this ductility exceeds the ductility required for the forming operation. After 1,000 hours at 1400° F., the room temperature tensile ductility to failure had decreased to about 10%, again this is a value which is not adequate to insure freedom from thermal fatigue during operation. The heat treatment finally identified which produced the desired level of as-aged ductility was a solution treatment at about 2300° F. followed by a one hour treatment at 2150° F. and a two hour treatment at 1900° F. This treatment produced material which had a room temperature tensile ductility to failure of between about 20% as heat treated and about 15% after a 1,000 hour treatment at 1400° F. Both the ductility in the heat treated condition and the ductility in the simulated aged condition were adequate for the desired application.

The solution treatment step may be carried out at temperature ranging from about 2250° to about 2350° F. provided that the incipient melting temperature is not exceeded. For wrought material in thin form such as for example sheet stock from which burners might be fabricated, short solution treatment times are adequate, times on the order of from about 10 minutes to about 1 hour. Of course, thicker sections may require longer times and in any event longer times are not deleterious. The first aging step may be carried out at temperatures from about 2100° F. to about 2200° F. for times on the order of from about one half hour to about two hours. The final aging step may be carried out at temperatures from about 1800° F. to about 2000° F. for times of from about one to about four hours. All heat treatments are preferably carried out in a nonoxidizing or reducing atmosphere. Hydrogen atmospheres have produced satisfactory results. Metal forming operations may be carried out between the initial solution heat treatment and the first aging step. In this instance, the heat treatment also serves as a stress-relief anneal. Metal forming operations may also be carried out between the first aging step and the second aging step. The second aging step is preferably performed on the finished burner assembly. The previously described heat treatment sequence produces beneficial results over the entire composition range. However, a narrowed composition range has been identified which possesses particularly good properties when the present heat treatment is applied. This narrowed composition range shown in Table I consists of from about 18 to about 23% chromium and from about 4.2 to about 4.6% aluminum. The remaining alloy ingredient composition ranges previously described are not changed. The effect of this narrowed composition range is to eliminate the embrittling sigma phase and to reduce Laves phase precipitation. The solution treatment step has the effect of completely dissolving all nonmatrix phases except for a few stable monocarbides. The two subsequent aging steps have the effect of precipitating the excess aluminum at grain boundary areas in the form of beta cobalt aluminide.

Although the invention has been shown and described with respect to preferred embodiments thereof, it should be understood by those skilled in the art that various changes and omissions in the form and detail thereof may be made therein without departing from the spirit and scope of the invention.

Having thus described a typical embodiment of our invention that which we claim as new and desire to secure by Letters Patent of the United States is:

1. A method of heat treating wrought cobalt alloys which contain about 18–25% chromium, about 3.7–4.6% aluminum, about 13–17% of a material selected from the group consisting of nickel and iron and mixtures thereof, about 2–4% of a material selected from the group consisting of tantalum and columbium and mixtures thereof, about 8–10% of a material selected from the group consisting of tungsten and molybdenum and mixtures thereof, about 0.5–2.0% hafnium, about 0.02–0.07% yttrium, about 0.25–0.45% carbon, balance essentially cobalt, said method comprising:

(a) solution heat treating the alloy at a temperature of between about 2250° F. and 2350° F., but below the incipient melting temperature, (b) aging the alloy at a temperature of from about 2100° F. to 2200° F. for a period of time from about one half to about two hours, (c) aging the alloy at a temperature of from about 1800° F. to about 2000° F. for a period of time from about one to about four hours.

2. A method as in claim 1 wherein the alloy contains:
22.5% chromium
15% nickel + iron
3% tantalum + columbium
10% tungsten and molybdenum
0.35% carbon
4.25% aluminum
1.25% hafnium
0–0.5% titanium
0.05% yttrium
0.0–0.5% boron
balance cobalt.

3. A method as in claim 1 wherein the alloy contains:
18–23% chromium
13–17% nickel
8–10% tungsten
2–4% tantalum
4.2–4.6% aluminum.

* * * * *